United States Patent [19]

DeZutter

[11] 4,069,641

[45] Jan. 24, 1978

[54] STORM WINDOW FRAMING

[75] Inventor: Theodore M. DeZutter, House Springs, Mo.

[73] Assignee: K-S-H, Inc., St. Louis, Mo.

[21] Appl. No.: 743,176

[22] Filed: Nov. 19, 1976

[51] Int. Cl.[2] ..... E04C 2/38

[52] U.S. Cl. ..... 52/202; 52/476; 52/716

[58] Field of Search ..... 52/202, 203, 475, 476, 52/716–718

[56] References Cited

U.S. PATENT DOCUMENTS

| | | | |
|---|---|---|---|
| 3,158,909 | 12/1964 | Downs | 52/202 |
| 3,248,840 | 5/1966 | Petterson | 52/502 |
| 3,307,309 | 3/1967 | Bloxsom | 52/716 X |
| 3,360,893 | 1/1968 | Wattelez | 52/202 |
| 3,455,080 | 7/1969 | Meadows | 52/476 |
| 3,668,808 | 6/1972 | Perina | 52/DIG. 13 |
| 3,939,620 | 2/1976 | Bero | 52/716 |

FOREIGN PATENT DOCUMENTS

| | | | |
|---|---|---|---|
| 338,957 | 7/1959 | Switzerland | 52/202 |

*Primary Examiner*—J. Karl Bell

*Attorney, Agent, or Firm*—Polster, Polster and Lucchesi

[57] ABSTRACT

Storm window framing, including a tape frame having a tape-receiving channel defined by spaced, parallel inner and outer ribs and one surface of a connecting web, a pane-receiving channel and a seat boss, the seat boss including a pair of spaced jaws defining between them a seat boss channel, keyhole-shaped in transverse section and with an outwardly opening, outwardly flaring mouth, and a glazing frame having a tenon strip with a head and neck adapted to fit in the keyhole-shaped seat boss channel and a root flared complementarily to and adapted to fill the mouth of the tape frame seat boss channel when the head and neck are fully seated, and, integral with and cantilevered from the root, a pane biasing leaf strip, extending at an angle toward the pane-receiving channel of the tape frame.

Preferably, the full framing includes a sill section, extending along a lower edge of a pane and engaging a window sill. The sill section is preferably a one-piece shape, with a pane-receiving channel, a pane biasing leaf strip extending at an angle toward the pane-receiving channel, and a base, extending from the pane-receiving channel and leaf strip a substantial distance beyond the leaf strip to form a wide, sill-engaging platform.

8 Claims, 6 Drawing Figures

STORM WINDOW FRAMING

BACKGROUND OF THE INVENTION

It has been proposed in the past to provide frost shields for windows and windshields, in which a frame is mounted on a window by means of tape or adhesive, as shown in patents to Hogelund, U.S. Pat. No. 1,777,435, and Walz, U.S. Pat. No. 2,111,343. Extruded plastic moldings for windows have been proposed, as indicated in U.S. Pat. Nos. 3,455,080, Meadows, and Crane, No. 3,363,390, and a combination of the two, in Bero, No. 3,939,620.

One of the objects of this invention is to provide a storm window frame of extruded plastic, which, through at least three sides, is provided with double-faced tape by which the frame can be mounted to an existing window, which is simpler, more economical, and more effective than any of the prior art devices.

Other objects will become apparent to those skilled in the art in the light of the following description and accompanying drawings.

SUMMARY OF THE INVENTION

In accordance with this invention, generally stated, a storm window framing is provided which includes a tape frame having a tape-receiving channel defined by spaced parallel inner and outer ribs and one surface of a connecting rib, a pane-receiving channel defined by an inner wall, another surface of the connecting web, and one external but inboard edge of a seat boss, the seat boss including a pair of spaced jaws defining between them a seat boss channel, keyhole-shaped in transverse section and with an outwardly opening, outwardly flaring mouth; and a glazing frame for a tenon strip with a head and neck adapted to fit in the keyhole shaped channel and a root flared complementarily to and adapted to fill the mouth of the tape frame seat boss channel when the head and neck are fully seated, and, integral with and cantilevered from the root, a pane biasing leaf strip, extending at an angle toward the pane-receiving channel of the tape frame, the leaf strip having at its outer end an out-turned lip. The arris between the lip and the edge of the leaf defined thereby along the inner wall of the tape frame. The glazing frame is stiffly flexible.

In the preferred embodiment, the framing members just described extend around two vertical sides and the top edge of a rectangular pane. Along its lower edge, the pane is seated between a pane-receiving channel corresponding to the pane-receiving channel of the rest of the frame, and a cantilevered pane-biasing leaf strip integral with a base. The base itself extends a substantial distance beyond the leaf strip, forming a relatively wide sill-engaging platform. The platform provides a better seal along the sill, where the seal is most important, but, not being adhered to the sill, permits the window to be moved relative to the sill.

DESCRIPTION OF THE PREFERRED EMBODIMENT

Figure 1:
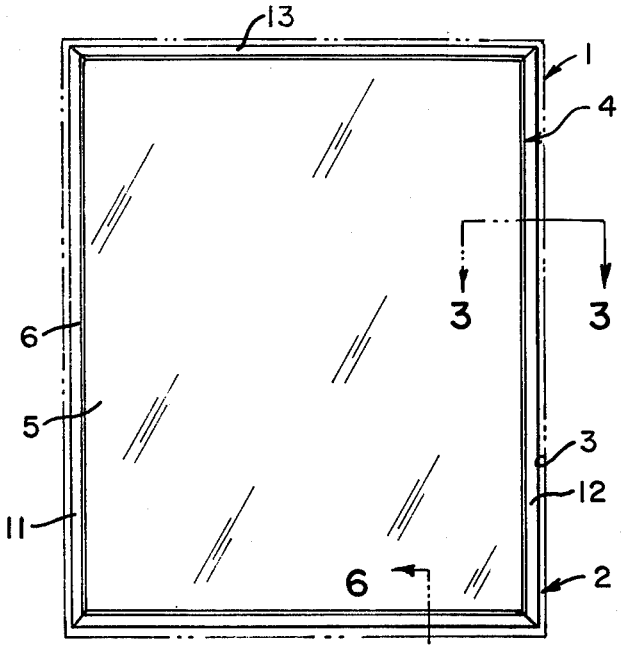
FIG. 1 is a view in front elevation of a window with a storm window frame of this invention in place.

Referring now to the drawings for one illustrative embodiment of frame of this invention, reference numeral 1 indicates a window with a frame 2 with a flat inside surface 3 extending entirely around it. A storm window 4 of this invention, with a pane 5 and a frame 6, is mounted on the window frame 2, in such a way as to engage a window sill 7 along its lower edge.

The storm window 6 is made up of side sections 11 and 12, a top section 13 and a sill section 14.

The side sections 11 and 12 and top section 13 can be of identical construction. Each of them is made up of a one-piece tape frame 20 and a one-piece glazing frame 21.

The tape frame has a tape-receiving channel 25 defined by an inner rib 26, an outer rib 27, and an outboard surface 28 of a connecting web 29.

A pane channel 30 is defined by an inner wall 32, an inboard surface 33 of the web 29, and an inner surface 39 of a seat boss 40.

The seat boss 40 has an inner jaw 41, and an outer jaw 42. The jaws 41 and 42 have facing surfaces which define a cylindrical cavity 43, a restricted channel 44 and an outwardly divergently flaring mouth 45. Between the outer margins of the mouth 45 and the inner surface 39 and a parallel outer surface, the seat boss 40 has planar top surfaces 46.

The glazing frame 21 has a tenon strip 50, with a polygonal head 51 with tapered sides 52, a neck 53 and a root 54 flared complementarily to the surfaces defining the mouth 45. The glazing frame has an outer sealing flange 57, a surface of which engages the surface 46 on the outer side of the root 54, a cover strip 58, which engages the surface 46 on the inner side of the root 54, and a leaf strip 60 integral at one end with the cover strip 58 and provided at its other end with an out-turned lip 61. An arris 62 between the meeting planes of the leaf strip and the lip, engages and runs along a facing flat surface of the inner wall 32 before the pane is mounted.

In this embodiment, the sill section 14 is made in one piece. It has a sill plate 65, along opposite long edges of which are sill engaging ribs 66 and 67. A pane channel 68 is defined by a top wall 69, a connecting web 70, and a top surface 71 of the sill plate 65. A spacing rib 72 projects from the connecting web 70 against the window frame surface 3.

Figure 6:
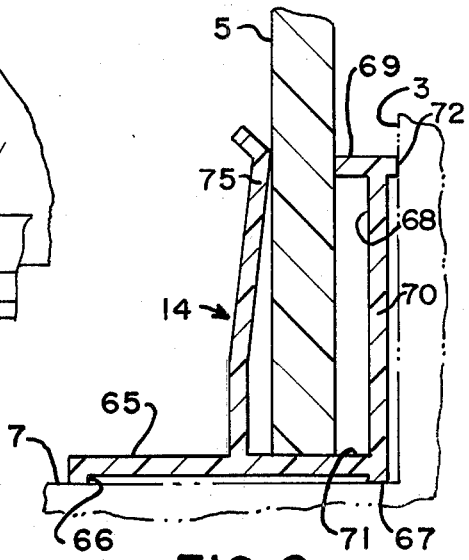
FIG. 6 is a sectional view taken along the line 6—6 of FIG. 1, showing a sill section of frame of this invention.

A sill biasing leaf strip 75 is integral along one edge with the sill plate 65. Like the leaf strip 60 the leaf strip 75 is self-biased into engagement with the wall 69 in the absence of a pane, and is stiffly resiliently biased continuously into engagement with the pane 5 when the pane is mounted between the wall 69 and the leaf strip 75. Like the leaf strip 60, the leaf strip 75 has an out-turned lip and an arris, as shown particularly in FIG. 6.

A double faced adhesive strip tape 80 with an inner sticky face 81 and an outer sticky face 82 is adhered on its sticky face 81 to the surface 28 of the tape-receiving channel 25, and, along sticky face 82, to the window frame surface 3.

The storm window frame members are easy to miter or cut to the appropriate length, being made of stiffly flexible plastic.

Figure 2:
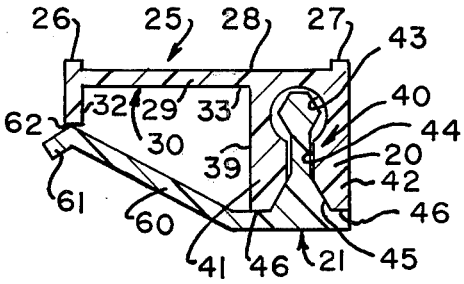
FIG. 2 is a transverse sectional view of a portion of the upper framing before it is placed around a pane, and without the double faced stripping by which it is adhered to the window.
Figure 3:
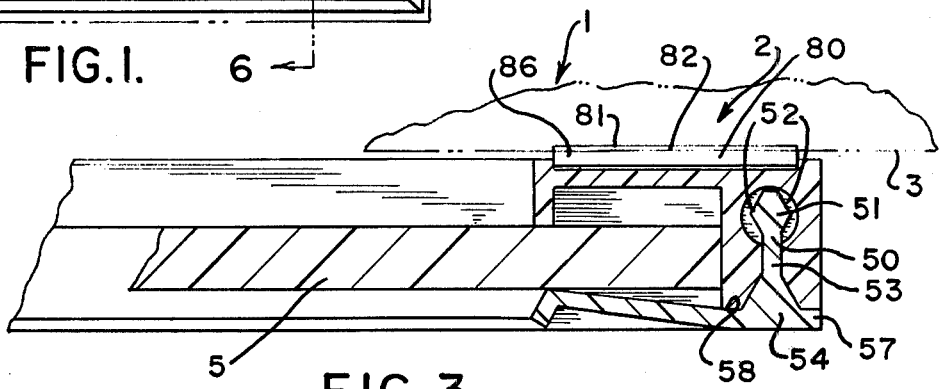
FIG. 3 is a sectional view taken along the line 3—3 of FIG. 1.
Figure 4:
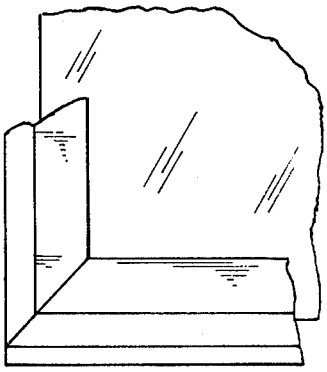
FIG. 4 is a fragmentary view showing a mitered corner of framing.
Figure 5:
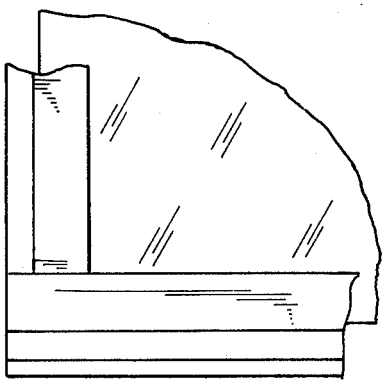
FIG. 5 is a view of a butt type corner.

In assembling the storm window of this invention, a pane, cut to the right dimensions, can have the sill section mounted on it, and then can be laid in a frame made up of the side sections 11 and 12 and top section 13 of the tape frame, to which tape 80 is adhered, the face 81 being covered with a stripable cover strip. The glazing frame members can then be put into place, usually by inserting the head 51 of the tenon strip at one end and progressively pushing the tenon strip down into the channel. The cover strip on the exposed sticky face 82 of tape 80 can then be removed, the storm window set upright on the sill, guided and located by the sill plate, and pushed into mounting engagement with the flat surface 3 of the window frame. If it is found more convenient, the frame members can be fitted, and either first assembled as shown in FIG. 2 and forced over and around the edges of the pane, or laid out and then assembled as has been indicated heretofore.

Once the tape frame members have been mounted, the pane of the storm window can be removed by pulling the glazing frame from the tape frame, progressively from one end, so as to replace the pane or to wash the facing surfaces of the main window and the storm window panes. The pane can then be remounted in place, as has been described.

One of the virtues of the storm window frame of this invention is that it can be made light and small, and still be effective. In practice, using a one-eighth inch thick plastic pane, the width of the tape frame, from the outer surface of the rib 27 to the outer surface of the rib 26 can be on the order of 0.53 inch; the width of the glazing frame, from the outermost edge of the lip 61 to the outermost edge of the flange 57, on the order of 0.56 inch; the overall height, from the base of the rib 27 to the top surface of the flange 57, on the order of 0.275 inch, and the height of the tenon strip from the inside surface of the flange 57 to the most remote surface of the head 51 on the order of 0.175 inch. The thickness of the leaf 60, neck 53, and web 29 can be on the order of 0.030 inch. The tenon-receiving channel can be about 0.20 inch deep.

The sill section wall thickness can also be about 0.030 inch, and the overall width, height and outside configurations, except for the sill plate, can be the same as that of the other sections, to permit a neat miter. The sill plate can be on the order of 0.53 inch long from the outside surface of the rib 67 to the outside surface of the rib 66.

A frame of these illustrative dimensions will accept glazing materials from 0.040 inch to 0.187 inch in thickness.

The dimensions are merely illustrative, but they indicate the small size and light construction of a commercially acceptable frame of this invention.

The plastic from which the frame members are made can be polyvinyl chloride, polypropylene, ABS (acrylonitrile-butadiene-styrene) or other suitable semi-flexible plastics.

Numerous variations and details of construction of the storm window of this invention, within the scope of the appended claims, will occur to those skilled in the art in the light of the foregoing disclosure.

Having thus described the invention, what is claimed and desired to be secured by Letters Patent is:

1. In a storm window wherein a pane is held in extruded frame members mounted to a window by adhesive, the improvement comprising, along at least two sides of said pane, a tape frame having a pane channel defined in part by an upstanding inner wall and one external surface of a boss at an outer edge of said tape frame, said boss including a pair of spaced jaws defining between them a channel, keyhole shaped in transverse cross section and with an outwardly opening, outwardly flaring mouth; an adhesive strip on one face of said tape frame; and a glazing frame, said glazing frame having a root portion at an outer edge of said glazing frame, said root portion of said glazing frame including mounting means cooperable with said boss for rendering said glazing frame mountable on and selectively demountable from said tape frame, said glazing frame mounting means comprising a tenon strip with a head and a neck adapted to fit in the keyhole shaped channel in said boss, said mounting means providing a single position interlock between said tape frame and said glazing frame, and, integral with and cantilevered from said root portion, a pane biasing leaf strip, extending at an angle toward the upstanding inner wall of the tape frame, the free end of said leaf strip having an outturned lip, the arris between said lip and the edge of the leaf defined thereby engaging and extending along said upstanding inner wall of said tape frame when no pane is mounted in said frame members, the free end of said leaf strip holding said pane to said upstanding inner wall of the tape frame, said glazing frame being made entirely of stiffly resilient plastic, the resiliency of said leaf strip being sufficient to hold panes ranging in thickness from 0.040 inches to 0.125 inches in tight contact with said upstanding inner wall of said tape frame.

2. The improvement of claim 1 wherein the jaws defining the seat channel have flat outer surfaces and the glazing frame has a flat flange surface in engagement with one of said jaw surfaces and a cover strip section with a surface in engagement with the other of said jaw surfaces.

3. The improvement of claim 1 wherein the head of the tenon strip is polygonal, with opposite, chamfered, outwardly convergently directed sides along its outer edge.

4. The improvement of claim 3 wherein the jaw channel is on the order of 0.20 inch deep and the tenon strip is on the order of 0.175 inch high from the base of the root to the top of the head.

5. The improvement of claim 1 including a sill section along a lower margin of said pane, adapted to engage a window sill, said sill section having a sill plate, and, integral with said sill plate, a pane channel defining wall and connecting web and a resilient pane biasing leaf strip, said leaf strip being spaced from said web and extending at an angle toward said pane channel defining wall, said leaf strip and pane channel defining wall receiving the pane between them, and said sill plate having sill-engaging ribs projecting from it, said sill section being unadhered to either the window frame or the sill.

6. The improvement of claim 1 wherein said keyhole shaped channel engages said neck of said tenon strip snugly and engages said head of said tenon strip loosely, to permit limited rocking of said glazing frame about said mounting means.

7. The improvement of claim 1 wherein said frame members have an overall width of less than 0.6 inches and an overall height of less than 0.3 inches.

8. The improvement of claim 1 wherein said tape frame includes a tape-receiving channel defined by an inner rib forming an extension of said upstanding inner wall, an outer rib forming an extension of said boss, and one face of a connecting web, the opposing face of the connecting web defining a part of said pane channel between said upstanding inner wall and said boss.

* * * * *

UNITED STATES PATENT AND TRADEMARK OFFICE

CERTIFICATE OF CORRECTION

PATENT NO. : 4,069,641

DATED : January 24, 1978

INVENTOR(S) : Theodore M. DeZutter

It is certified that error appears in the above-identified patent and that said Letters Patent are hereby corrected as shown below:

Column 1, line 45, after "thereby" insert ---extends---.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*